US005538785A

United States Patent [19]

Dingler

[11] Patent Number: 5,538,785

[45] Date of Patent: Jul. 23, 1996

[54] CONSTRUCTION ELEMENT

[76] Inventor: Gerhard Dingler, Schillerstrasse 49, 7274 Haiterbach, Germany

[21] Appl. No.: 615,349

[22] Filed: Nov. 19, 1990

[51] Int. Cl.[6] ..... B32B 3/26

[52] U.S. Cl. ..... 428/290; 428/256; 428/314.4; 428/317.9; 428/319.3; 428/328

[58] Field of Search ..... 428/314.4, 319.9, 428/319.3, 328, 256, 283, 290

[56] References Cited

U.S. PATENT DOCUMENTS

| | | | |
|---|---|---|---|
| 3,647,608 | 3/1972 | Enlow et al. | 428/319.1 |
| 4,221,697 | 9/1980 | Osborn et al. | 524/853 |
| 4,248,931 | 2/1981 | Salman | 428/318.8 |
| 4,542,054 | 9/1985 | Fillmann | 428/68 |
| 4,925,719 | 5/1990 | Staneluis et al. | 428/71 |

FOREIGN PATENT DOCUMENTS

| | | | |
|---|---|---|---|
| 1058396 | 2/1967 | United Kingdom | 428/314.4 |

*Primary Examiner*—Terrel Morris

[57] ABSTRACT

The object is to make a construction element lighter and in particular to increase the modulus of elasticity. This takes place by a foamed plastic layer bonded with solid plastic outer shell regions 12, 13 and metal mats 22, 23 laid therein. The plastic contains pieces of metal strip that are bent in a three dimensional configuration.

50 Claims, 3 Drawing Sheets

FIG. 1
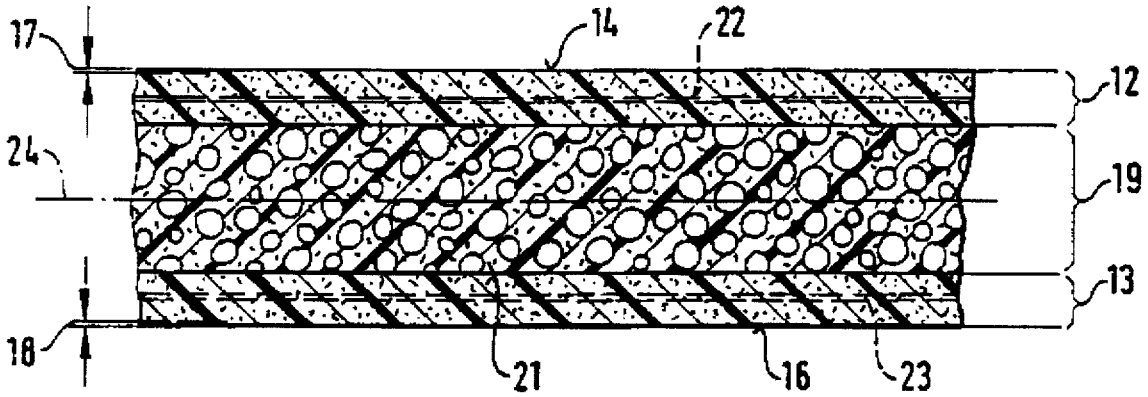
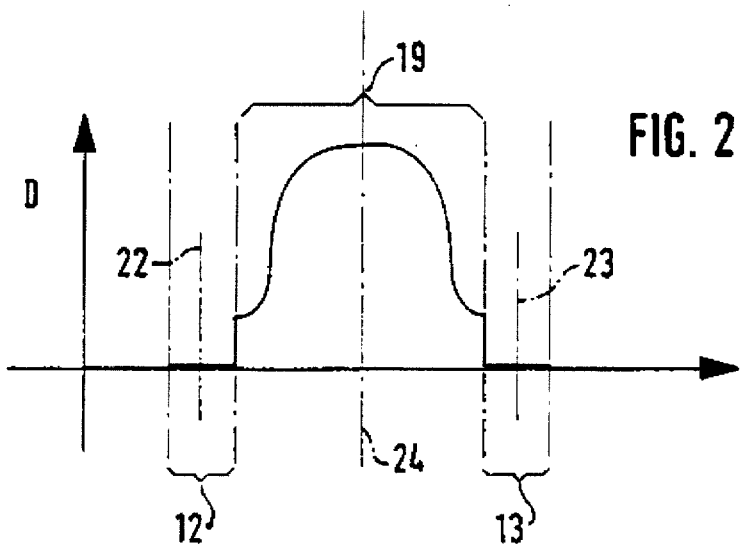
FIG. 2

CONSTRUCTION ELEMENT

BACKGROUND OF THE INVENTION

Timber itself is becoming rarer and rarer and types of timber having the same properties are becoming even more rare. On the other hand, petroleum appears to be far more available than was hitherto assumed. Recent finds in Saudi Arabia make it appear that petroleum production is assured at least until the century after next. This means that plastic is available. The problems of what is to happen with used plastic are very pressing even now. So-called recycling presents great problems, since nobody can think of a satisfactory way of putting large quantities of plastic to renewed use.

OBJECT AND STATEMENT OF THE INVENTION

The object of the invention is to further improve the structural elements of a construction element comprised of more than 50% plastic and less than 50% reinforcing material. Special attention has been paid to rigidity, nailability, creep behavior, thermal conductivity and temperature resistance.

According to the invention, this object is achieved by the construction element having the following features:

a sandwich structure having two outer shell regions, each of said outer regions being provided with a surface area, each of said outer shell regions being solid at least in said surface area, said sandwich structure having an inner region comprising a foamed plastic layer that is firmly bonded to said outer shell regions, said sandwich structure having a mat of metal filaments embedded in at least one of said outer shell regions and oriented substantially parallel to said surface area, said construction element being comprised of more than 50% plastic and less than 50% reinforcing material, said reinforcing material being comprised substantially of pieces of metal strip, and each of said pieces of metal strip having a substantially flat cross-section and being bent into a three-dimensional configuration.

Additionally, the invention includes the following advantageous features:

The mat has, transversely to both its extents, clearances which are at least large enough that the plastic material penetrates them. The plastic material completely penetrates the mat and completely wets all the surfaces of the mat.

The proportion by weight of the pieces of metal strip in the foamed plastic layer is considerably less than in the outer shell region. The proportion by weight is between 0 and 25%; 0 and 20%; 0 and 15%; 0 and 10%; and is 5% with a range of variation of +150%–100%.

The outer shell regions are, added in their thickness, thinner than the foamed plastic layer. The thicknesses are in the ratio of 4:15:4 with a range of variation of about ±100%.

The outer shell regions are approximately the same thickness and, in particular, exactly the same thickness.

The pore size of the foamed platic layer decreases from its center plane outward. The decrease is constant.

The outer shell region has small pores in its inner region. The mat lies in the pore-free region.

A mat is provided only in one outer shell region, or a mat is provided in each outer shell region. Each mat has the same structure. Both mats are the same distance from the center plane of the construction element.

The coefficient of thermal conductivity in the respective regions corresponds to the coefficient of thermal conductivity of a formwork sheet of a formwork panel of element formwork for concrete formwork.

The modulus of elasticity in the respective regions corresponds to the modulus of elasticity of a formwork sheet of a formwork panel of element formwork for concrete formwork.

This applies analagously also to the creep behavior and/or the temperature resistance.

The mat is a woven fabric, or a plaited work, or a knitted fabric. The woven fabric is a plain weave, or a twill weave. The plaited work is a fence netting.

The metal filaments have a diameter of less than 1 mm., in particular, less than 0.5 mm, or the diameter lies in the lower tenths of a millimeter range, in particular, in the range from 0.05 mm to 0.2 mm.

The metal filaments are of a material of high modulus of elasticity. The modulus of elasticity at 20° C. is over 10,000 kg/mm$^2$, in particular, at 18,000–23,000 kg/mm$^2$.

The modulus of elasticity range is that of steel wire.

The metal filaments are coated with molybdenum, or the metal filaments are galvanized.

The mat is embedded in the middle region of the outer shell, or the mat is embedded in the outer region of the outer shell, but does not reach the surface at any point.

The mat has a distance from the surface which is at least five times the diameter of the metal filament.

The plastic blend of the outer shell regions is the same as that of the foamed plastic layer, or the plastic blends have different, purpose-adapted properties.

The construction element has the same properties in its X direction and Y direction.

THE DRAWINGS

Preferred exemplary embodiments will now be described with reference to the schematic drawings, in which:

FIG. 1 shows a broken-off cross-section through a sheet, such as can be used for example as a formwork sheet, FIG. 2 shows a diagram of the random distribution of foam pore diameters on either side of the geometrical center plane for a first exemplary embodiment, FIG. 3 shows a representation such as FIG. 2, but for a second exemplary embodiment, FIG. 4 shows the plan view of a mat of metal filaments, FIG. 5 shows a cross-section through a mold with layers to be laid in, in an exploded state, FIG. 6 shows the representation of an extrusion process.

DETAILED DESCRIPTION OF PREFERRED EMBODIMENTS

Figure 3:
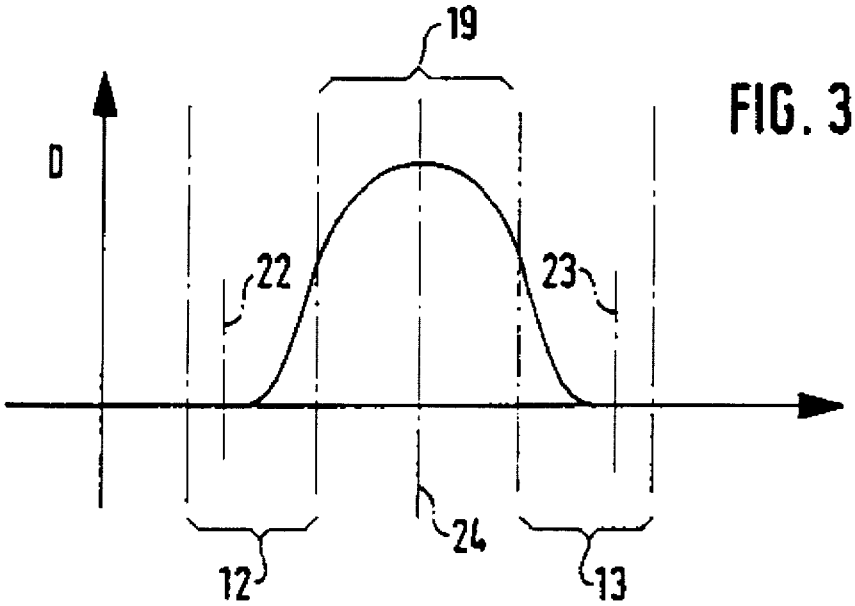

According to FIG. 1, the construction element has the form of a formwork panel sheet 11, which can be used for concrete formwork It has two outer shell regions 12, 13. These have outer surfaces 14, 16, which are adjoined by surface regions 17, 18, which make up a part of the thickness of the outer shell regions 12, 13. Between 12, 13 there is an inner region 19, which has foamed plastic 21. In the outer shell regions 12 and 13, there are mats 22, 23. These, and so too 12, 13, 14, 16, 17, 18, 19, 21, extend parallel to a geometric center plane 24.

Depending on the production process, the diameter of the foam cells, of which the foamed plastic 21 is composed for its greater part, varies from the solid surface regions 17, 18 to the geometrical center plane 24. FIG. 2 shows this. Around the goemetrical center plane 24, the diameter D of the cells is at its greatest, then decreases to the beginning of 12, 13 and in 12, 13 the diameter is zero, in other words the outer shell regions 12, 13 are solid.

In the case of another production process, according to FIG. 3, the foam region even reaches into the outer shell regions 12, 13, but with cells diminishing to zero diameter. Where the mats 22, 23 are, the cell diameter has however already dropped to zero before this. Therefore, as in the case of the exemplary embodiment according to FIG. 2, the mats 22, 23 are An solid material.

Figure 4:
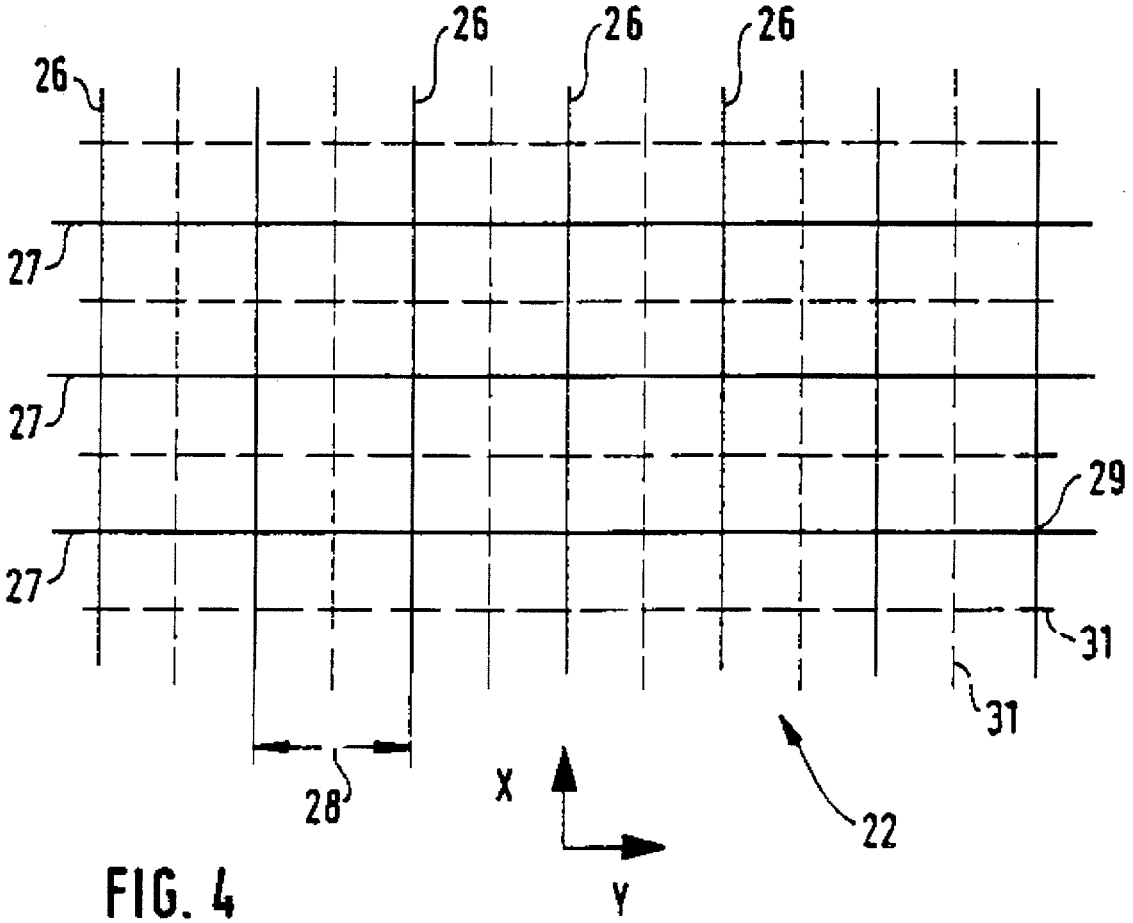

According to FIG. 4, metal filaments 26 and metal filaments 27 form the mat 22. The mat 23 looks exactly the same and is therefore not described. The metal filaments 26, 27 are of steel and 0.16 mm thick. The metal filaments 26 run in the X direction and the metal filaments 27 in the Y direction, that is to say that they are perpendicular to one another. The mesh width 28 is the same size in both directions, namely 7×7 mm. It is ensured in a way not shown that the crossing points 29 remain unmoved. For the eventuality that the metal filaments 26, 27 cannot be worked due to their openness, the mat 22 is made better to handle by an auxiliary framework 31, which is connected in a way not shown to the metal filaments 26, 27. The auxiliary framework 31 is composed of filaments of quite considerably lower tensile force and does not determine the properties of the formwork panel sheet 11, or only to a very small extent.

Figure 5:
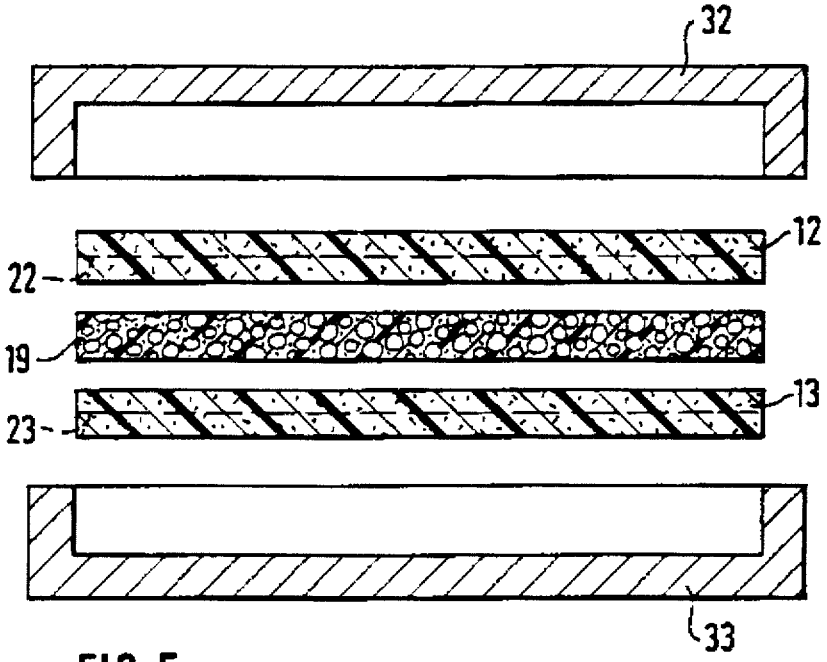

FIG. 5 shows at the top a sectioned mold half 32 and at the bottom a complementary mold half 33. These can be pressed together under pressure and temperature. Pressed together in them are 12, 22 on the one hand, 13, 23 on the other hand, which are already ready-made in some other way, and between the two 19. Then a formwork panel sheet 11 according to FIG. 2 is obtained, provided that the initial height of 12, 13, 19 is at first greater than the clear height with closed mold halves 32, 33. 12, 13 then press a little into 19, but do not themselves become foamed.

Figure 6:
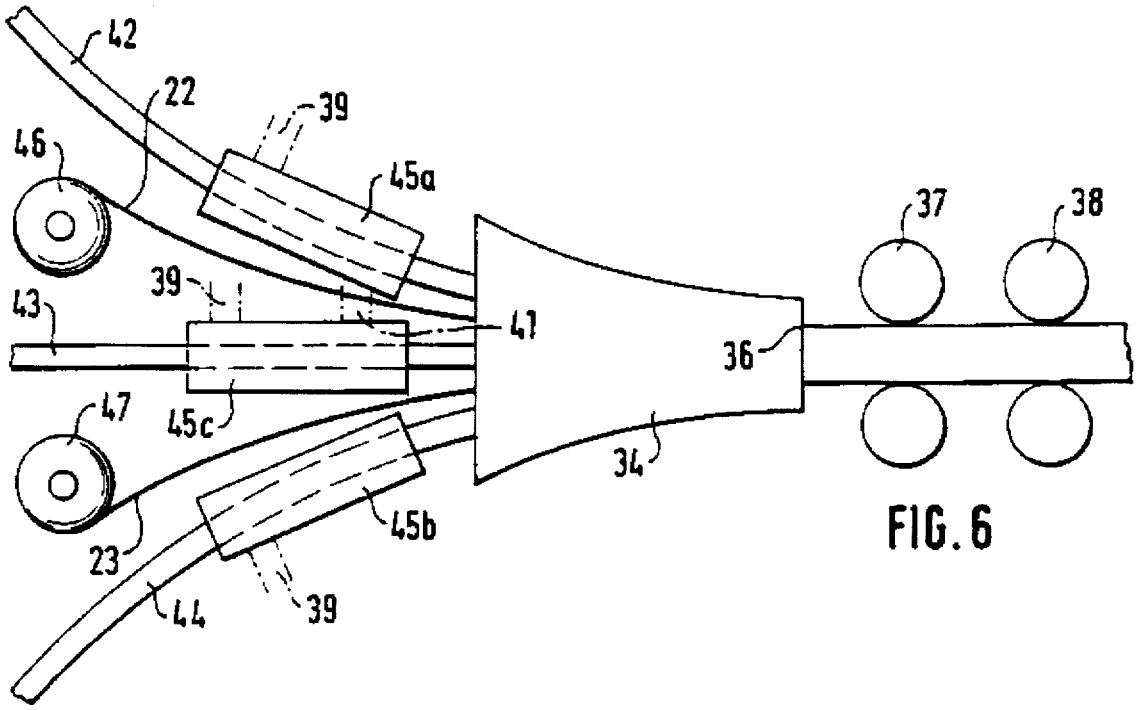

According to FIG. 6, for a second process one has a funnel 34, with slot die 36. Downstream of this are two pairs of calender rollers 37, 38. The funnel is charged with material 42, 43, 44 as well as with the fed mats 22, 23. The materials 42 and 44 are worked up by means of an extruder 45*a, b* each, which in each case contains a vent zone 39. The material 43 is passed via an extruder 45*c*, which has a vent zone 39 and thereafter a gas feed zone 41. According to the main application P39 16 938.3, the plastic material 42, 43, 44 is enriched with pieces of metal strip. Furthermore also with chopped glass fibers. Between 42 and 43, a mat 22, 23 is in each case fed by supply rollers 46, 47 underneath. 42, 43, 44 are brought together in the funnel 34. In the vent zone 39, gas which has for instance occurred unintentionally and/or by chance is drawn off. In the gas feed zone 41, gas is fed in a controlled manner into the material 43, which later forms the inner region 19. In this way one has control over a cell diameter profile as for example in FIG. 4. The feed of the plastic material 42, 43 is to be understood as drawn symbolically. Sheets are of course not fed in. The pairs of rollers 37, 38 smooth the outer surfaces 14, 16 on the product until it has cooled.

As the claims already reveal, the invention is capable of numerous variations. The formwork panel sheet 11 is only built up symmetrically to the geometrical center plane 24 if one wishes to have symmetrical properties. If one of the mats 22, 23 is omitted, the product has a one-sided prestress, which is desirable for some applications. The outer surfaces 14, 16 may, if desired, also be textured. In certain application cases, both mats 22, 23 may be present. In such cases, one may lie a little further inwards and the other a little further outwards and/or the metal filaments may have differing properties, which can likewise result in a desired symmetry. The metal filaments 26, 27 may be in a plastic sheath,which is welded at the crossing points 29, making the auxiliary framework 31 superfluous. The plastic sheath then melts in the plastic fed in. The mat 23 may be knitted or woven. However, it may also be a metal sheet from which very many parts have been punched out, so that only bars remain. Such metal sheets are sometimes produced when punching out small parts.

If it is known that the construction element will not be used from both sides (formwork panel sheets are turned), the structure of the sandwich may also be modified accordingly.

If desired, the construction element may be lighter than timber, but have better mechanical properties.

If, in the case of the formwork panel sheet 11, one of the outer surfaces 14, 16 is worn, the surface can be regenerated in a simple way, by for example using a glowing wire as a smoothing instrument or hot-ironing the surface.

Owing to the foam structure, the inner region 19 has, apart from the plastic component, only a very low proportion of pieces of metal strip and glass fibers. It is in each case less than 10%. In the case of the exemplary embodiment, in the range of 5% aluminum chips and 5% glass fibers. The nailability is directly dependent on the polyamide content, dependent on the proportion of HDPE and LDPE. Nailability ceases at about 18% PA. Admixtures of LDPE make the construction element easier to nail. However, the shear absorption and creep resistance are then reduced. If HDPE and LDPE are added in the same ratio, the polyamide content can be increased to 30%, at which point nailability ceases. The nailability is not impaired by the degree of filling with reinforcing materials, in other words the pieces of metal strip and the glass fibers, as long as the individual proportion lies below 22%. Beyond this, the material becomes too dense.

The creep behavior is dependent on the concentration of the reinforcing materials and their length in the final product, provided that their adhesion and integration is ensured. It appears that chips or the like of a length of 12 to 13 mm are most effective and make the formwork panel sheet 11 appear as a spring which returns to its original position immediately a load is removed and, under continuous loading, very quickly approaches a final deformation.

The thermal conductivity influences to a great degree the compression time and the setting behavior of the concrete. The thermal conductivity is determined exclusively by the concentration of pieces of metal strip. With a proportion of 15% aluminum chips, values of a comparable timber sheet are obtained. The good thermal conductivity produces quite a uniform cooling of the construction element, with the result that no stresses are implanted. This guarantees a warp-free form in the cooled state.

The higher the polyamide content, the greater the resistance to temperature. However, from a certain percentage, this property of polyamide reduces the nailability. Tests on prototypes showed that a range from 12 to 25%, depending on mixing ratio, of PE optimizes both factors, so that a relatively high temperature resistance is achieved and the construction element can nevertheless be nailed.

The outer shell regions 12, 13 are highly filled, for example with 20% aluminum chips, 20% glass fibers, 20% PA and 20% HDPE and LDPE, respectively. It should be possible, by the dimensioning of the mats 22, 23, for less glass fibers and aluminum chips to be used.

The inner region 19 is only sparsely filled, for example up to 5% aluminum chips and glass fibers. Due to the foamed zone, a considerable weight reduction is produced, for example of 60%.

A process according to FIG. 5 is admittedly not as cost-effective as a process according to FIG. 6. However, production is achieved more quickly. The converse is true for a process according to FIG. 6.

A minimum spacing of 7×7 mm was admittedly mentioned in the case of the exemplary embodiment for the mesh width 28 in both directions. Depending on static requirements, this may be greater or else smaller, and in addition different in one direction in relation to the other.

The mats may also consist of ribbed expanded metal. In this case, in principle hybrid forms are also possible, such as ribbed expanded metal and/or strip from which parts have been punched out and/or knitted and/or woven mats.

The layers, such as mats, foamed plastics, outer shells etc., lie substantially parallel to one another and the mats are substantially planar.

I claim:

1. A construction element for building construction, comprising a sandwich structure having two outer shell regions comprised with plastic, each of said outer shell regions being provided with a surface area, each of said outer shell regions being solid at least in said surface area, said sandwich structure having an inner region comprising an intermediate foamed plastic layer, said outer shell regions being firmly bonded together by said intermediate foam plastic layer, said sandwich structure having a first reinforcing material comprising a mat of metal filaments embedded in at least one of said outer shell regions and oriented substantially parallel to said surface area, wherein said outer shell regions and said inner region further comprise a second reinforcing material, and said outer shell regions and said inner region are more than 50% plastic and less than 50% of said second reinforcing material, said second reinforcing material is comprised substantially of pieces of metal strip, and each of said pieces of metal strip has a substantially flat cross-section and is bent into a three dimensional configuration.

2. A construction element as claimed in claim 1, wherein the mat has transverse extents and transversely to its extents clearances which are at least large enough that the plastic material penetrates them.

3. A construction element as claimed in claim 2, wherein the mat has surfaces and the plastic material completely penetrates the mat and completely wets all the surfaces of the mat.

4. A construction element as claimed in claim 1, wherein the proportion by weight of the pieces of metal strip in the foamed plastic layer is considerably less than in the outer shell regions.

5. A construction element as claimed in claim 4, wherein the proportion by weight of pieces of metal strip is between 0 and 25%.

6. A construction element as claimed in claim 5, wherein the proportion by weight of pieces of metal strip is between 0 and 20%.

7. A construction element as claimed in claim 4, wherein the proportion by weight of pieces of metal strip is between 0 and 15%.

8. A construction element as claimed in claim 4, wherein the proportion by weight of pieces of metal strip is between 0 and 10%.

9. A construction element as claimed in claim 4, wherein the proportion by weight of pieces of metal strip is 5% with a range of variation of +150%–100%.

10. A construction element as claimed in claim 1, wherein the outer shell regions are, added in their thickness, thinner than the foamed plastic layer.

11. A construction element as claimed in claim 10, wherein the thicknesses of the outer shell regions and foamed plastic layer are in the ratio of 4:15:4 with a range of variation of about ±100%.

12. A construction element as claimed in claim 1, wherein the outer shell regions are approximately the same thickness.

13. A construction element as claimed in claim 12, wherein the outer shell regions are exactly the same thickness.

14. A construction element as claimed in claim 1, wherein the foamed plastic layer has a center plane and pores with sizes that decrease from its center plane outward.

15. A construction element as claimed in claim 14, wherein the decrease is constant.

16. A construction element as claimed in claim 14, wherein the outer shell regions have inner areas with small pores.

17. A construction element as claimed in claim 1, wherein the outer shell regions have inner areas with small pores and pore-free areas and said mat lies in a pore-free area.

18. A construction element as claimed in claim 1, wherein a mat is provided only in one of the outer shell regions.

19. A construction element as claimed in claim 1, wherein a mat is provided in both of the outer shell regions.

20. A construction element as claimed in claim 19, wherein each mat has the same structure.

21. A construction elment as claimed in claim 19, wherein the construction element has a center plane and both mats are spaced equally from the center plane of the construction element.

22. A construction element as claimed in claim 1, wherein the coefficient of thermal conductivity of said construction element corresponds to the coefficient of thermal conductivity of a formwork sheet comprised of wood of a formwork panel for concrete formwork.

23. A construction element as claimed in claim 1, wherein the modulus of elasticity of said construction element corresponds to the modulus of elasticity of a formwork sheet comprised of wood of a formwork panel for concrete formwork.

24. A construction element as claimed in claim 1, wherein the creep behavior and the temperature resistance of said construction element corresponds to the creep behavior and temperature resistance of a formwork sheet comprised of wood of a formwork panel for concrete formwork.

25. A construction element as claimed in claim 1, wherein the mat is a woven fabric.

26. A construction element as claimed in claim 1, wherein the mat is a plaited work.

27. A construction element as claimed in claim 1, wherein the mat is a knitted fabric.

28. A construction element as claimed in claim 25, wherein the woven fabric is a plain weave.

29. A construction element as claimed in claim 25, wherein the woven fabric is a twill weave.

30. A construction element as claimed in claim 26, wherein the plaited work is a fence netting.

31. A construction element as claimed in claim 1, wherein the metal filaments have a diameter of less than 1 mm.

32. A construction element as claimed in claim 31, wherein the diameter of the metal filaments is less than 0.5 mm.

33. A construction element as claimed in claim 1, wherein the diameter of the metal filaments lies in the lower tenths of a millimeter range.

34. A construction element as claimed in claim 33, wherein the diameter of the metal filaments lies in the range from 0.05 mm to 0.2 mm.

35. A construction element as claimed in claim 1, wherein the metal filaments are of a material of high modulus of elasticity.

36. A construction element as claimed in claim 35, wherein the modulus of elasticity of the metal filaments at 20° C. is over 10,000 kg/mm.

37. A construction element as claimed in claim 36, wherein the modulus of elasticity of the metal filaments lies at 18,000–23,000 kg/mm.

38. A construction element as claimed in claim 35, wherein the modulus of elasticity range is that of steel wire.

39. A construction element as claimed in claim 1, wherein the metal filaments are coated with molybdenum.

40. A construction element as claimed in claim 1, wherein the metal filaments are galvanized.

41. A construction element as claimed in claim 1, wherein the outer shell regions have a middle region and the mat is embedded in the middle region of at least one of the outer shell regions.

42. A construction element as claimed in claim 1, wherein each of the outer shell region has an outer region and the mat is embedded in the outer region of at least one of the outer shell regions, and is spaced from the surface area.

43. A construction element as claimed in claim 42, wherein the mat is spaced from the surface area by a distance at least five times the diameter of the metal filament.

44. A construction element as claimed in claim 1, wherein the plastic has a composition of materials in the outer shell regions that is the same as that of the foamed plastic layer.

45. A construction element as claimed in claim 1, wherein the plastic has composition of materials in the outer shell regions and foamed plastic layer that have different, purpose-adapted properties.

46. A construction element as claimed in claim 1, having an X direction and a Y direction with the same properties in the X direction and the Y direction.

47. A construction element as claimed in claim 20, wherein the construction element has a center plane and both mats are spaced equally from the center of the construction element.

48. A construction element for building construction as claimed in claim 1, wherein said pieces of metal strip comprise aluminum chips.

49. A construction element for building construction as claimed in claim 1, wherein the coefficient of thermal conductivity of said construction element corresponds to the coefficient of thermal conductivity of a formwork sheet comprised of wood of a formwork panel for concrete formwork.

50. A construction element for building construction as claimed in claim 48, wherein said aluminum chips comprise aluminum foil chips.

* * * * *